United States Patent [19]

Mrenna

[11] Patent Number: 5,008,645

[45] Date of Patent: Apr. 16, 1991

[54] CIRCUIT BREAKER WITH TAMPER INDICATING CALIBRATION MEANS

[75] Inventor: Stephen A. Mrenna, Brighton Township, Beaver County, Pa.

[73] Assignee: Westinghouse Electric Corp., Pittsburgh, Pa.

[21] Appl. No.: 559,861

[22] Filed: Jul. 30, 1990

[51] Int. Cl.[5] ..... H01H 71/06; H01H 75/10; H01H 77/04

[52] U.S. Cl. ..... 337/70; 337/82; 335/42; 335/45

[58] Field of Search ..... 337/70, 82; 335/42, 335/45

[56] References Cited

U.S. PATENT DOCUMENTS 3,566,318 12/1968 Gelzheiser et al. .
3,849,747 11/1974 Mrenna et al. .
4,148,004 4/1979 Gelzheiser .
4,630,019 12/1986 Maier et al. ..... 337/70

*Primary Examiner*—Harold Broome
*Attorney, Agent, or Firm*—M. J. Moran

[57] ABSTRACT

A circuit breaker with a thermal trip has a calibration opening in the electrically insulating housing through which a tool may be inserted and rotated to distort a support plate on which a bimetal is mounted to calibrate the thermal trip after the circuit breaker has been fully assembled and enclosed within the insulating housing. A tamper indicating seal in the form of a destructible film secured over the calibration opening by an adhesive having an adhesive strength exceeding the tensile strength of the destructible film provides a visual indication of any subsequent attempts to tamper with the calibration setting.

10 Claims, 4 Drawing Sheets

FIG. 1
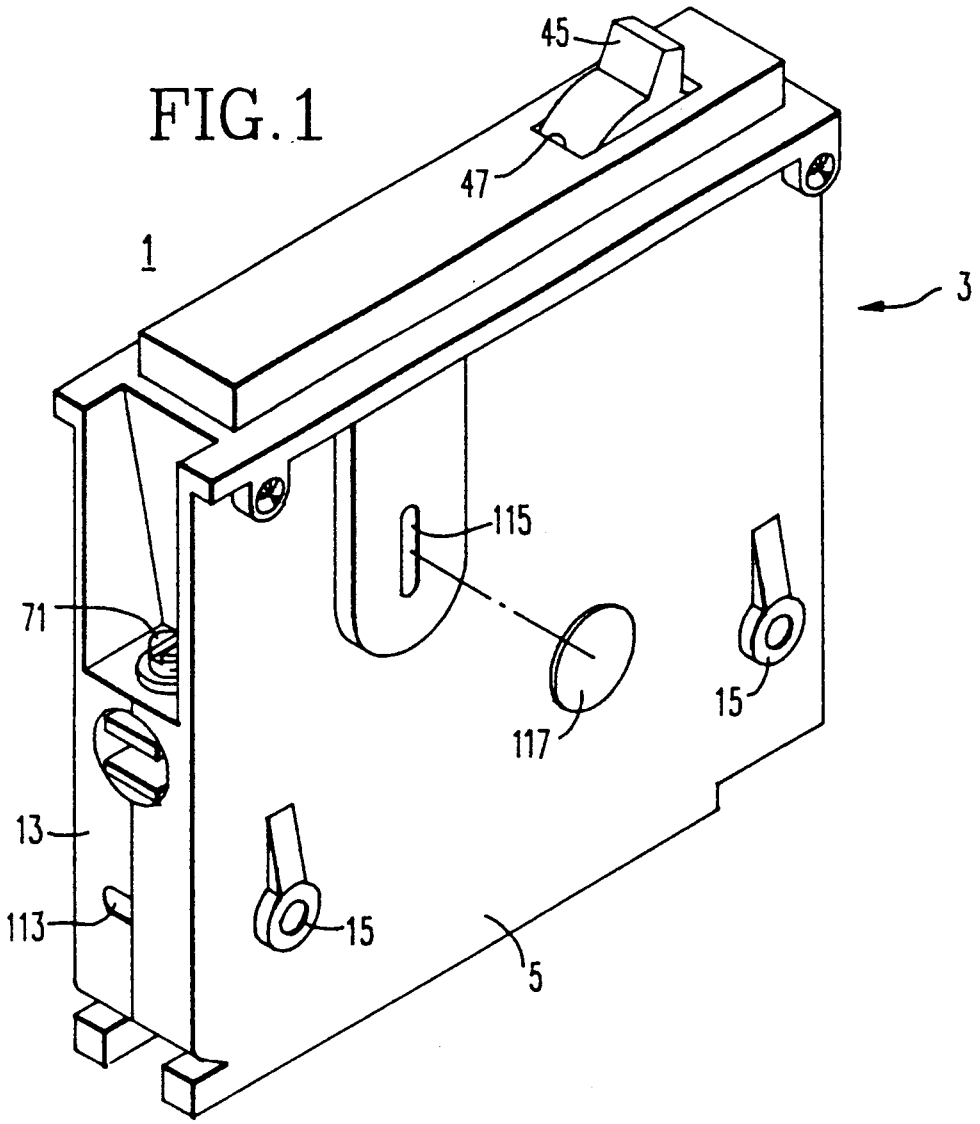
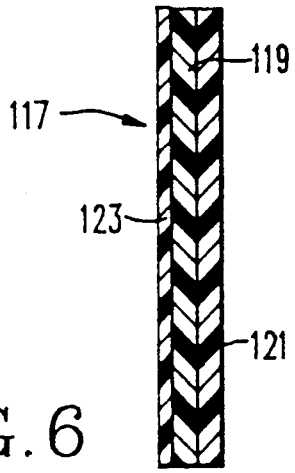
FIG. 6

CIRCUIT BREAKER WITH TAMPER INDICATING CALIBRATION MEANS

BACKGROUND OF THE INVENTION

1. Field of the Invention

This invention relates to circuit breakers, and more particularly to a circuit breaker which can be calibrated after final assembly and having means to provide evidence of an attempt to tamper with the calibration setting.

2. Background Information

A common type of circuit breaker used to automatically interrupt abnormal currents in an electrical system incorporates a thermal trip device which responds to persistent low levels of overcurrent and a magnetic trip assembly which responds instantly to higher levels of overcurrent. In such circuit breakers the thermal trip device comprises a bimetal which flexes in response to the persistent low level overcurrent passed through it to unlatch a latchable operating mechanism. The latchable operating mechanism is spring operated to open electrical contacts which interrupt the current. Typically, the circuit breaker mechanism is mounted in a housing comprising a base section forming a cavity in which the circuit breaker mechanism is assembled, and a cover which is secured in place over the base to enclose the circuit breaker mechanism. Industry standards require that the thermal trip device in these circuit breakers be calibrated to trip the breaker in response to an overcurrent of a predetermined magnitude within a specified time interval. Commonly, this calibration of the thermal trip is performed "on the half shell." That is, the circuit breaker mechanism is assembled within the cavity of the breaker housing, and the thermal trip is calibrated before the mechanism is enclosed by the cover.

A common type of circuit breaker in which the thermal trip is calibrated in this manner is shown by way of example in U.S. Pat. No. 3,849,747. Such circuit breakers have been in use for many years and their design has been refined to provide an effective, reliable circuit breaker which can be easily and economically manufactured on a large scale. This type of circuit breaker has a metal support plate with an integral tab extending laterally from one end to which the bimetal of the thermal trip device is secured. The end of the support plate from which the tab extends is partially separated from the remainder of the support plate which is fixed in the housing by a transverse slot. The bimetal is calibrated by closing the circuit breaker and applying the prescribed overcurrent. A tool is inserted in the transverse slot in the support plate and when the specified time has expired, the tool is rotated to distort the free end of the support plate thereby adjusting the position of the support for the bimetal to cause the bimetal to trip the breaker This calibration is presently carried out automatically, "on the half shell" by a machine. With the calibration set, the cover is installed and riveted in place. The circuit breaker is then tested to validate the calibration. Circuit breakers which do not pass the calibration test are reworked by inserting a hook through a slot in the end of the circuit breaker to engage the free end of the bimetal to attempt to bring it within tolerance. Such reworking is done manually, and being difficult to perform, only results in bringing about half of the rejected circuit breakers into tolerance.

It has been determined that the number of circuit breakers which fail the calibration test performed after the cover has been installed is in part due to minor changes in position and distortion of the mechanism resulting from misalignment of the housing parts causing the breaker to fall out of calibration In order to overcome these effects, U.S. Pat. No. 4,148,004 proposes a circuit breaker of this type which is fully assembled with the cover riveted in place, and is then calibrated by a plug rotatably mounted in the wall of the housing and having a bifurcated stem which engages the tab on the support plate and the fixed end of the bimetal. A tool is inserted in apertures in the external face of the calibrating plug and rotated to set the calibration. Thus, the circuit breaker is calibrated after it has been fully assembled and the parts are fixed in their final position. However, it also allows one to change the calibration which is not conformance with electrical codes in the United States.

There remains a need therefore for a circuit breaker which provides higher yields in calibration testing.

More particularly, there is a need for such a circuit breaker which can be calibrated after it has been fully assembled with its cover in place.

There is a further need for such a circuit breaker which can be calibrated after assembly, but which provides an indication that an attempt has been made to change the calibration once set.

Summary of the Invention

These and other needs are satisfied by the invention which is directed to a circuit breaker having a calibration opening in the housing through which a tool is insertable to adjust the bimetal of the trip mechanism to trip the circuit breaker at a predetermined persistent overload condition after the circuit breaker assembly has been installed within the housing with the cover sealed to the base, and tamper indicating seal means sealing the calibration opening in the housing from subsequent access. In a preferred embodiment of the invention, the circuit breaker assembly includes a support plate mounted in a cavity in the circuit breaker housing and extending along a planar wall of the housing. This support plate has a main portion fixed in the housing and a free end partially separated from the main portion by a transverse slot. The free end of the support plate supports the bimetal of the trip assembly. The calibration opening extends through the planar wall of the base of the housing and is aligned with the transverse slot in the support plate through which a tool is inserted to engage the transverse slot and rotate the free end of the support plate carrying the bimetal to calibrate the circuit breaker at the selected persistent current overload with the circuit breaker assembled and enclosed within the housing. Preferably, the calibration opening of this embodiment of the invention is provided with the tamper indicating seal means.

The preferred form of the seal comprises a destructible film and an adhesive securing the destructible film to the housing over the calibration opening and having an adhesive strength greater than a tensile strength of the destructible film. In a modified form of the invention, the destructible film and the circuit breaker housing are of contrasting colors, but the destructible film has a paint applied to match the color of the housing. A clear lamination adhered to the destructible film peels from the destructible film taking with it the paint to expose the contrasting color of the destructible film if the seal is scraped.

With the invention, the circuit breaker can be calibrated after it has been fully assembled so that the parts are in their final position, thereby increasing the yield of circuit breakers within calibration tolerance. At the same time, a circuit breaker is protected from tampering with the calibration setting.

BRIEF DESCRIPTION OF THE DRAWINGS

A full understanding of the invention can be gained from the following description of the preferred embodiment when read in conjunction with the accompanying drawings in which:

FIG. 1 is a partially exploded isometric view of a circuit breaker in accordance with the invention.

FIG. 6 is an edge view of a tamper indicating seal which forms part of the circuit breaker of the invention.

DESCRIPTION OF THE PREFERRED EMBODIMENT

Figure 2:
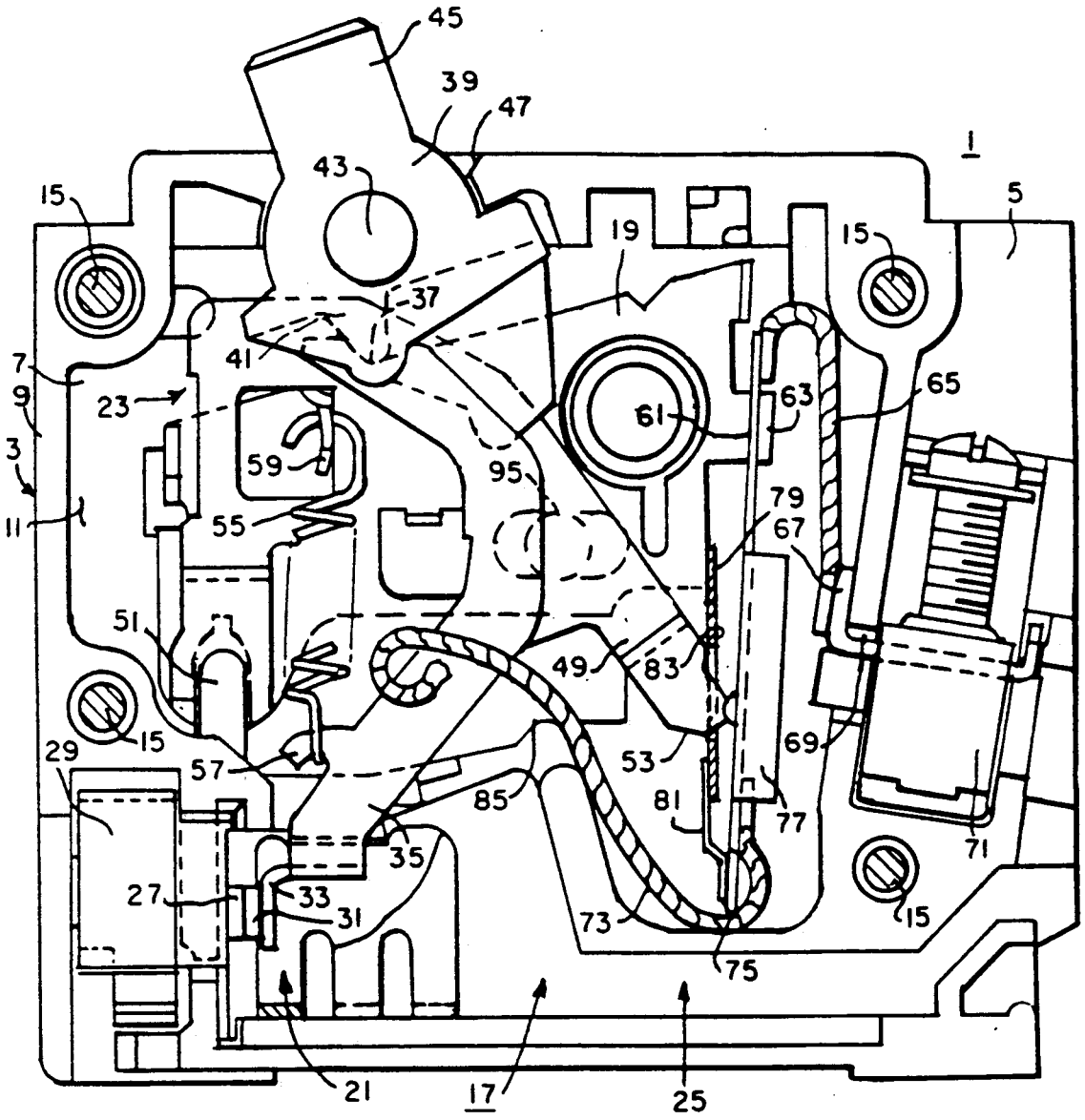
FIG. 2 is a side view of the circuit breaker of FIG. 1 with the cover removed and the circuit breaker mechanism shown in the closed position.
Figure 3:
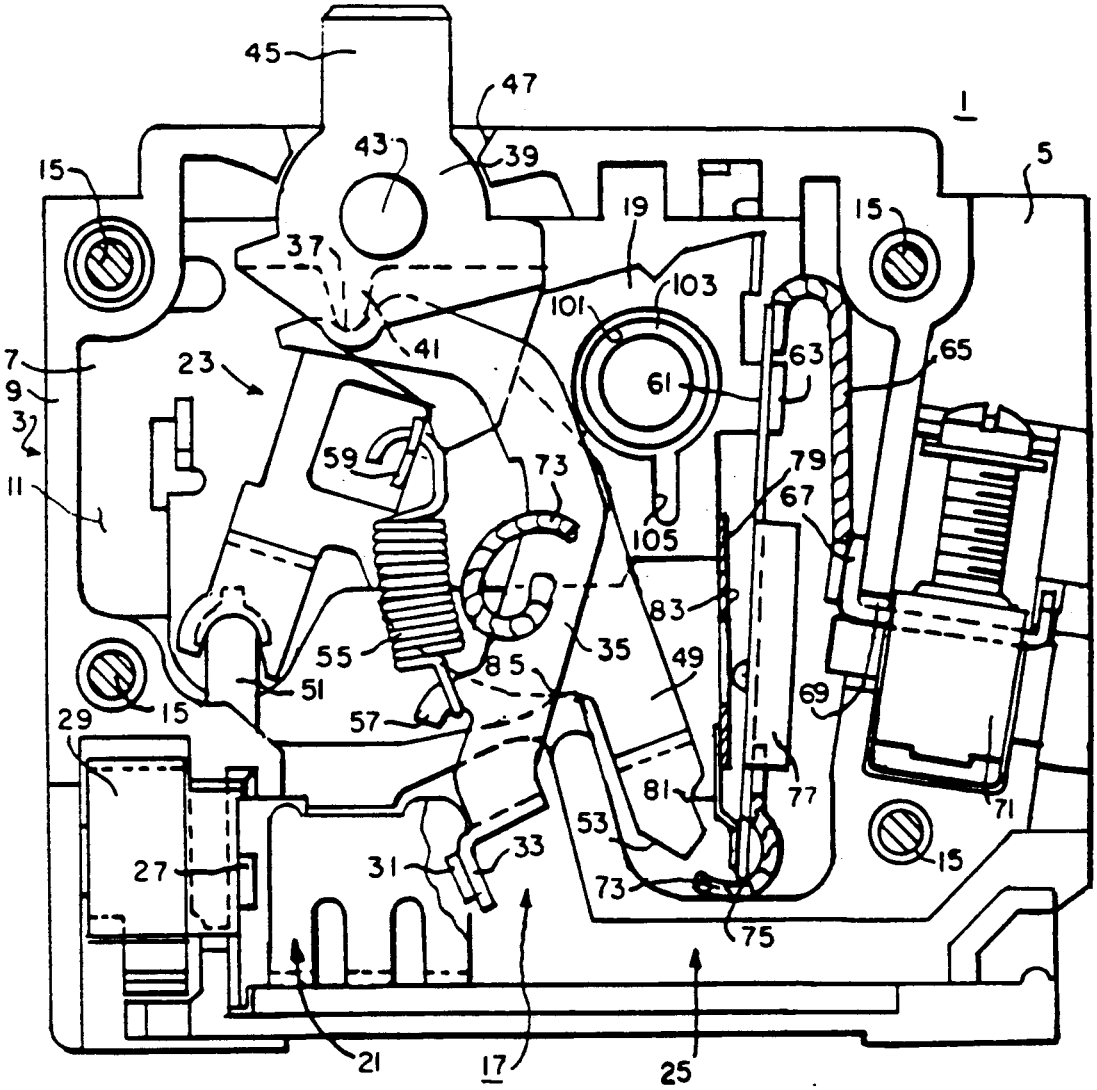
FIG. 3 is a side view similar to that of FIG. 2 showing the circuit breaker in the tripped position.

Referring to the drawings, the circuit breaker 1 of the invention comprises an electrically insulating housing 3 having a molded insulating base 5 having a planar wall 7 and edge walls 9 forming a cavity 11. The housing 3 further includes a molded insulating cover 13 which is secured to the base 5 by four rivets 15. A circuit breaker assembly, indicated generally at 17 in FIGS. 2 and 3, is supported in the cavity 11 of the housing. The circuit breaker assembly 17 includes a stationary support plate 19, a set of electrical contacts 21, a latchable operating mechanism 23 and trip assembly 25.

The set of electrical contacts 21 includes a stationary contact 27 secured to a plug-in type line terminal 29, a movable contact 31 secured to a small flange 33 on one end of a flat metallic, generally C-shaped contact arm or switch arm 35 which forms part of the latchable operating mechanism 23. The contact arm is provided at the upper end with a depression 37. A molded insulating operating member 39 has a molded part 41 which engages the depression 37 in the contact arm 35 to provide a driving connection between the operating member 39 and the contact arm 35. The operating member 39 is molded with a pair of pins 43 extending outwardly on opposite sides (only one shown) which fit into bearing openings (not shown) in the base 5 and the cover 13 of the housing 3 to support the operating member 39 for pivoted movement. The operating member 39 includes a handle part 45 which extends through an opening 47 on top of the housing 3 to enable manual operation of the circuit breaker 1.

The latchable operating mechanism 23 also includes a cradle 49 supported at one end for pivoted movement on a molded post part 51 of the insulating housing base 5. The other end of the cradle 49 has a latch ledge 53 which is latched by the trip assembly 25 which will be described in detail. An over center tension spring 55 is connected, under tension, at one end to a projection 57 near the lower end of the contact arm 35, and at the upper end thereof to a bent over projection 59 on the cradle 49.

The trip assembly 25 comprises an elongated bimetal member 61 secured, in proximity to its upper end, to a bent over tab part 63 on the support plate 19. A flexible conductor 65 is secured at one end to the upper end of the bimetal member 61 and at the other end to a conductor 67 that extends through an opening 69 in the housing 3 and is part of a solderless terminal connector 71 that is externally accessible and supported in the housing 3 in a well known manner. Another flexible conductor 73 is secured at one end to the free, lower end 75 of the bimetal member 61 and at the other end thereof to the contact arm 35 to electrically connect the contact arm 35 with the bimetal member 61.

The electrical circuit through the circuit breaker 1 extends from the line terminal 29, through the stationary contact 27, the movable contact 31, the contact arm 35, the flexible conductor 73, the bimetal member 61, the flexible conductor 65, the conductor 67, and the solderless terminal connector 71.

As more fully described in detail in U.S. Pat. No. 3,849,747 which is hereby incorporated by reference, the circuit breaker 1 may be manually operated to open and close the set of electrical contacts 21 by operation of the operating member 39 through the handle portion 45. The circuit breaker 1 is also operated automatically in response to overload conditions by the trip assembly 25.

The trip assembly 25 includes a thermal trip capability which responds to persistent low level overcurrents and a magnetic trip capability which responds instantaneously to higher overload currents. The trip assembly 25 includes the bimetal member 61, a magnetic yoke 77 and a magnetic armature 79. The magnetic yoke 77 is a generally U-shaped member secured to the bimetal member 61 at the bight portion of the magnetic yoke 77 with the legs thereof facing the armature 79. The magnetic armature 79 is secured to a supporting spring 81 that is in turn secured, at its lower end, near the free end 75 of the cantilevered bimetal member 61. Thus, the armature 79 is supported on the bimetal member 61 by the spring 81. The armature 79 has a window opening 83 through which the one end of the cradle 49 extends with the latch ledge 53 on the cradle engaging the edge of the window 83 to latch the latchable operating mechanism 23 in the latched position as shown in FIG. 2.

With the circuit breaker in the on position shown in FIG. 2, a persistent overload current of a predetermined value causes the bimetal member 61 to become heated and deflect to the right as viewed in FIG. 2 to effect a time delayed thermal tripping operation. The armature 79, which is supported on the bimetal member 61 by means of the leaf spring 81, is carried to the right with the bimetal member 61 to release the cradle 49. When the cradle 49 is released, the spring 55 rotates the cradle clockwise on the post 51 until this motion is arrested by the engagement of the cradle 49 with a molded part 85 of the housing base 5. During this movement, the line of action of the spring 53 moves to the right of the point at which the contact arm 35 is pivoted on the operating member 39 to rotate the contact arm 35 counterclockwise to snap the set of electrical contacts 21 open. In addition, the operating member 39 is rotated to position the handle 45 to a position intermediate of the "on" and "off" positions to provide a visual indication that the circuit breaker 1 has tripped open. The tripped position of the parts is shown in FIG. 3. The circuit breaker is reset by moving the handle 45 to the full clockwise off position (not shown) to relatch the cradle 49 and is then rotated counterclockwise to the on position shown in FIG. 2 which moves the upper end of the contact arm 35 to the right of the line of action of the spring 55 to snap the contacts to the closed position.

The circuit breaker 1 is magnetically tripped automatically and instantaneously in response to overload currents above a second predetermined value higher than the predetermined value for the thermal trip. Flow of overload current above this higher predetermined value through the bimetal member 61 induces magnetic flux around the bimetal. This flux is concentrated by the magnetic yoke 77 toward the armature 79. Overload current above the second predetermined value generates a magnetic force of such a strength that the armature 79 is attracted toward the magnetic yoke 77 resulting in the flexing of the spring 81 permitting the armature 79 to move to the right to release the cradle 49 and trip the circuit breaker open in the same manner as described with regard to the thermal tripping operation. Following a magnetic trip operation, the circuit breaker is reset and relatched in the same manner as described above.

The bimetal member 61 is designed to respond to persistent low level overcurrents inversely as a function of time. That is, the greater the magnitude of the current the shorter the time for the thermal trip. While the construction of the bimetal unit is such that it conforms to the inverse current characteristic reliably, the circuit breaker 1 must be calibrated to assure that this inverse current response characteristic produces a trip at code specified conditions. Typically, the circuit breaker 1 is calibrated so that at 250% of rated current it trips within 15 to 25 seconds. The circuit breaker 1 is calibrated by applying the specified overcurrent to the circuit breaker, and then adjusting the circuit breaker mechanism so that it trips within the specified time period. Thus, for example, in the case of a 20 amp circuit breaker, 50 amperes are applied to the circuit breaker in the closed position, and the circuit breaker mechanism is adjusted so that a trip occurs within 15 to 25 seconds.

Figure 4:
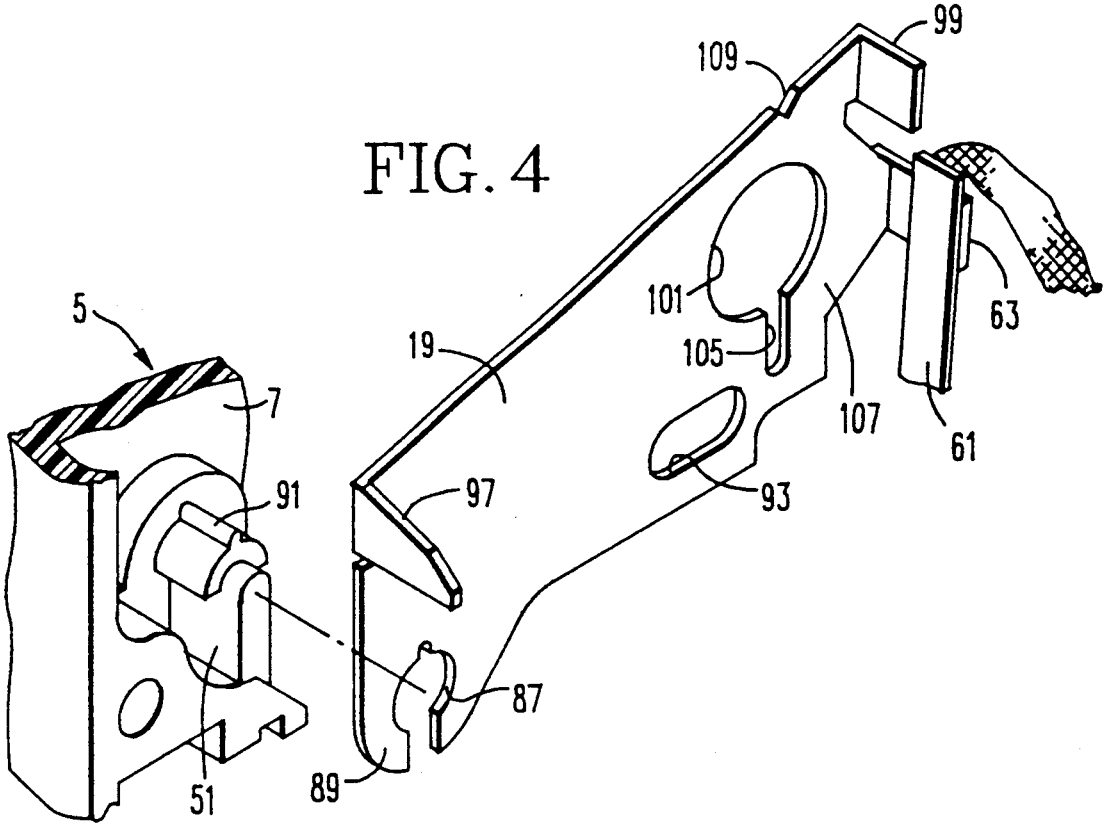
FIG. 4 is an isometric view of a support plate and its mount which form a part of the circuit breaker of FIG. 1.
Figure 5:
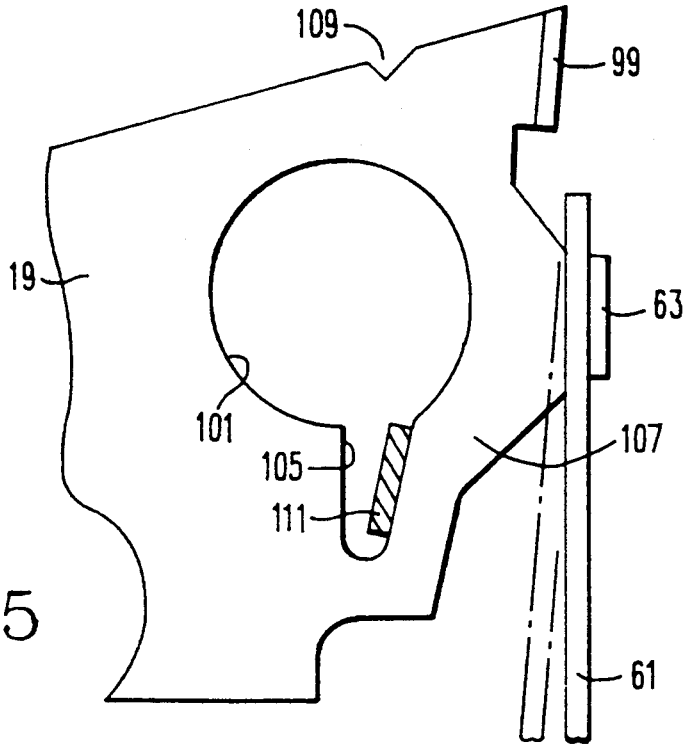
FIG. 5 is a fragmentary view of a portion of the support plate of FIG. 4 illustrating a calibration adjustment made in accordance with the invention.

Calibration of the circuit breaker 1 is effected through adjustment of the support plate 19 which is shown in more detail in FIGS. 4 and 5. The support plate 19 has an opening 87 in the lobe 89 at one end which is keyed to and engaged by a projection 91 on the cradle support post 51 molded into the planar wall 7 of the housing base 5. An oval shaped opening 93 spaced from the opening 87 engages a molded pin 95 on the planar wall 7 of the housing 5. The openings 87 and 93 fit snugly over the projection 91 and pin 95 to firmly fix the position of the support plate 19 within the housing base 5. Bent over tabs 97 and 99 at the two upper ends of the support plate 19 butt against the cover 13 of the housing to further maintain the fixed position of the support plate when the circuit breaker 1 is assembled. A large aperture 101 near the right hand end of the support plate 19 accommodates an annular flange 103 molded on the wall 7 of the base 5 through which a cam can extend when the circuit breaker is coupled with a similar circuit breaker to form a two-pole breaker in which simultaneous tripping of both poles is affected by the cam extending through the flange 103. For two-pole operation, the portion of the wall 7 aligned with the flange 103 is knocked out to accommodate the cam.

The opening 101 and an intersecting slot 105 partially separate the free end 107 from the remainder of the support plate 19. A notch 109 in the top edge of support plate 19 further weakens the connection of the free end 107 to the remainder of the support plate. The tab 63 to which the bimetal 61 is secured extends laterally from the free end portion 107 of the support plate 19.

Heretofore, the circuit breaker 1 has been calibrated by assembling the circuit breaker assembly 17 within the cavity 11 of the housing base 5, and before the cover is installed, applying the calibrating current to the terminals 29 and 71 with the circuit breaker closed. With the circuit breaker 1 in this in the "on the half shell" condition, a tool 111 is inserted into the slot 105. When the prescribed time at the calibrating overcurrent has elapsed, the tool 111 is rotated to distort the free end 107 of the support arm thereby rotating tab 63 carrying the bimetal 61 and forcing the breaker to trip. As seen in FIG. 5, the distortion causes the bimetal 61 to rotate from the phantom position to the full line position. This calibration is performed automatically by a machine which applies current to the terminals, inserts the tool 111 into the slot 105, and rotates the tool 111 to force the breaker to trip upon expiration of the prescribed time. Once the circuit breaker 1 has been calibrated, the cover 13, is placed over the base 5 to enclose the cavity 11 and is secured in place by the rivets 15. The circuit breaker is then tested by again applying the calibrating current and observing whether the breaker trips at the prescribed time within specified tolerances. If the circuit breaker 1 does not pass the test, a hook is inserted through an opening 113 molded in the housing base 5 to engage the free end of the bimetal and either push or pull the bimetal in an attempt to bring the thermal trip within the calibration limits. This repair is performed manually and is difficult to implement. While this repair procedure has increased the number of circuit breakers within calibration tolerance, it is the purpose of the invention to increase overall yield rate even more, and to do so without the necessity of the time consuming and difficult to implement repair procedure.

In accordance with the invention, an opening 115 is provided through the planar wall 7 of the housing base 5 in alignment with the slot 105 in the support plate 19. With this opening 115, the thermal trip of the circuit breaker can be calibrated with the circuit breaker assembled and the cover 13 secured in place by the rivets 15 by inserting the tool 111 into the slot 105 in the support plate 19 from outside the circuit breaker through the opening 115. Thus, the circuit breaker is calibrated with the parts assembled in the final positions in which they will remain during operation of the circuit breaker. This has been found to significantly increase yield of circuit breakers passing the subsequent calibration test. Code standards require that the opening 115 not have a width greater than 7/64 inch (0.278 cm), hence, an elongated opening is utilized.

It is an object of the present invention to preclude tampering with the calibration setting. Accordingly, a tamper indicating seal 117 is installed over the opening 115 to provide a visual indication of any attempt to change the calibration setting. In the exemplary embodiment of the invention, the tamper indicating seal comprises a destructible disk which is applied to the base 5 of the housing over the opening 115. As best seen in FIG. 6, this exemplary seal 117 includes a base layer 119 of a destructible film. An adhesive 121 is secured to the destructible film layer 119 for securing the seal 117 to the circuit breaker housing. This base layer 119 is of a contrasting color to that of the housing 3, but is painted to match the color of the housing. For example, the housing can be black and the vinyl layer white. A lamination 123 of clear film is adhered to the painted base layer 119. The adhesive layer 121 has an adhesive strength which exceeds the tensile strength of the base layer 119 and the lamination 123. Thus, if the seal 117 is removed to gain access to the opening 115, it will be destroyed. Even if just an attempt is made to remove the seal 117, the lamination 123 will be lifted taking with it paint so that a portion of the white base layer 119 will be exposed to provide a visual indication that the seal has been tampered with. In the exemplary circuit breaker, the base layer 119 is a 2.5 mil destructible white vinyl film which is painted black. The lamination layer 123 is a clear one mil polypropylene film and the adhesive is an AS-45 permanent acrylic adhesive applied in a layer which is 0.0009 plus/minus 0.0002 inches thick.

The present invention provides a means of calibrating a circuit breaker after it has been assembled, utilizing an automatic calibrating machine if desired, thereby increasing the yield of circuit breakers meeting the calibration standards, and at the same time provides a deterrent to tampering with the calibration setting once made.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker comprising an electrically insulating housing including a base defining a cavity and a cover for enclosing said cavity, a circuit breaker assembly within the cavity in said housing and comprising electrical contacts movable between open and closed positions, an operating mechanism including a cradle latchable in a latched position and operative when unlatched to automatically move said electrical contacts to said open position, a trip mechanism including an elongated bimetal which latches said cradle in the latched position and which flexes to unlatch said cradle in response to predetermined persistent current overload conditions, and a calibration opening in said housing through which a tool is insertable to adjust the bimetal to calibrate said predetermined persistent current overload conditions at which said bimetal unlatches said cradle to move said electrical contacts to the open position after said circuit breaker assembly has been installed in said cavity and the cavity has been enclosed with said cover secured to said base, and tamper indicating seal means sealing said calibration opening in said housing from subsequent access.

2. The circuit breaker of claim 1 wherein said seal comprises a destructible film and an adhesive securing said destructible film to said housing over said calibration opening and having an adhesive strength greater than the tensile strength of said destructible film.

3. The circuit breaker of claim 2 wherein said destructible film and said housing are of contrasting colors, and said destructible film has a paint applied to match the color of the housing and wherein said seal further includes a clear lamination adhered to said destructible film and which is peeled from said destructible film taking with it the paint to expose the contrasting color of said destructible film if the seal is scrapped.

4. A circuit breaker comprising an electrically insulating housing including a base having a planar wall and edge walls forming a shallow cavity and a cover enclosing said cavity when the circuit breaker is fully assembled, a circuit breaker assembly within the cavity within said housing and comprising electrical contacts movable between open and closed positions, an operating mechanism including a cradle latchable in a latched position and operative when unlatched to automatically move said electrical contacts to said open position, a trip mechanism including an elongated bimetal which latches said cradle in the latched position and which flexes to unlatch said cradle in response to predetermined persistent current overload conditions, and a support plate mounted in said cavity and extending along said planar wall of the base of said housing with a main portion fixed in said housing and a free end partially separated from the main portion by a transverse slot, said free end having a laterally extending tab to which said elongated bimetal is fixed, said circuit breaker further including an opening in said planar wall of the base of said housing aligned with said transverse slot in said support plate through which a tool is inserted to engage said transverse slot and rotate said free end portion of the support plate and said bimetal therewith to calibrate the unlatching of said cradle at said selected persistent current overload with said circuit breaker assembled with said housing cover engaging said housing base to enclose said circuit breaker assembly within said cavity.

5. The circuit breaker of claim 4 wherein said calibration opening in said base of said housing is an elongated slot having a width not greater than about 7/64 inch.

6. The circuit breaker of claim 5 including a tamper indicating seal means sealing said calibration opening against subsequent access.

7. The circuit breaker of claim 6 wherein said tamper indicating seal means comprises a destructible film and an adhesive securing said destructible film to said housing over said calibration opening and having an adhesive strength greater than the tensile strength of said destructible film.

8. The circuit breaker of claim 6 wherein said destructible film and said housing are of contrasting colors, and said destructible film has a paint applied to match the color of the housing and wherein said seal further includes a clear lamination adhered to said destructible film and which is peeled from said destructible film taking with it the paint to expose the contrasting color of said destructible film if the seal is scrapped.

9. The circuit breaker of claim 4 including a tamper indicating seal means sealing said calibration opening against subseqent access.

10. The circuit breaker of claim 9 wherein said tamper indicating seal means comprises a destructible film and an adhesive securing said destructible film to said housing over said calibration opening and having an adhesive strength greater than the tensile strength of said destructible film.

* * * * *